US011193213B2

(12) United States Patent
Fernández Sanchis et al.

(10) Patent No.: US 11,193,213 B2
(45) Date of Patent: Dec. 7, 2021

(54) DEVICE AND METHOD FOR THE ELECTROCHEMICAL UTILISATION OF CARBON DIOXIDE

(71) Applicant: Siemens Aktiengesellschaft, Munich (DE)

(72) Inventors: Elvira María Fernández Sanchis, Erlangen (DE); Marc Hanebuth, Nuremberg (DE); Harald Landes, Rückersdorf (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 345 days.

(21) Appl. No.: 16/305,496

(22) PCT Filed: May 8, 2017

(86) PCT No.: PCT/EP2017/060885
§ 371 (c)(1),
(2) Date: Nov. 29, 2018

(87) PCT Pub. No.: WO2017/207220
PCT Pub. Date: Dec. 7, 2017

(65) Prior Publication Data

US 2020/0325587 A1 Oct. 15, 2020

(30) Foreign Application Priority Data

May 31, 2016 (DE) ..... 10 2016 209 451.3

(51) Int. Cl.
*C25B 15/08* (2006.01)
*C25B 13/02* (2006.01)
(Continued)

(52) U.S. Cl.
CPC ..... *C25B 15/08* (2013.01); *C25B 3/25* (2021.01); *C25B 9/19* (2021.01); *C25B 13/02* (2013.01)

(58) Field of Classification Search
None
See application file for complete search history.

(56) References Cited

U.S. PATENT DOCUMENTS 5,437,771 A 8/1995 Shimamune et al. ..... 205/466
8,357,270 B2 1/2013 Gilliam et al. ..... 204/263
(Continued)

FOREIGN PATENT DOCUMENTS

AU 2017/273604 A1 10/2018 ..... C25B 1/00
CN 101649464 A 2/2010 ..... C25B 1/02
(Continued)

OTHER PUBLICATIONS

Lebrun et al, Elaboration of a new anion-exchange membrane with semi-interpenetrating polymer networks and characterisation, Electrochimica Acta, vol. 50, No. 4, Dec. 2004, pp. 985-993 (Year: 2004).*

(Continued)

*Primary Examiner* — Harry D Wilkins, III
(74) *Attorney, Agent, or Firm* — Slayden Grubert Beard PLLC

(57) ABSTRACT

Various embodiments may include an electrolyzer for electrochemical utilization of carbon dioxide comprising: electrolysis cell defining an anode space and a cathode space; an anode in the anode space; a cathode in the cathode space; a first cation-permeable membrane disposed between the anode space and the cathode space; and a second anion-selective membrane disposed between the first cation-permeable membrane and the cathode. The anode directly adjoins the first cation-permeable membrane. The second (Continued)

anion-selective membrane directly adjoins the first cation-permeable membrane and the second anion-selective membrane directly adjoins the cathode.

12 Claims, 1 Drawing Sheet

(51) Int. Cl.
*C25B 3/25* (2021.01)
*C25B 9/19* (2021.01)

(56) References Cited

U.S. PATENT DOCUMENTS

| | | | | |
|---|---|---|---|---|
| 9,217,202 | B2 | 12/2015 | Wang et al. | |
| 2012/0241378 | A1* | 9/2012 | Riviello | C25B 15/08 210/656 |
| 2014/0357904 | A1 | 12/2014 | Teamey et al. | 568/891 |
| 2015/0041323 | A1* | 2/2015 | Faita | C25B 5/00 204/533 |
| 2016/0108530 | A1 | 4/2016 | Masel et al. | 204/265 |
| 2017/0037522 | A1* | 2/2017 | Kaczur | C25B 1/04 |
| 2017/0183789 | A1* | 6/2017 | Matthews | C25B 9/08 |
| 2020/0318247 | A1* | 10/2020 | Fernandez Sanchis | C25B 11/0447 |

FOREIGN PATENT DOCUMENTS

| | | | | |
|---|---|---|---|---|
| CN | 101910469 | A | 12/2010 | B01D 61/42 |
| CN | 102912374 | A | 2/2013 | C25B 13/02 |
| CN | 103160851 | A | 6/2013 | C25B 11/06 |
| CN | 103191633 | A | 7/2013 | B01D 53/62 |
| CN | 105297067 | A | 2/2016 | C25B 1/00 |
| DE | 69418239 | T2 | 11/1999 | C25B 1/30 |
| DE | 10 2009 013 207 | A1 | 9/2010 | B01D 61/44 |
| JP | 2006219746 | A | 8/2006 | C25B 1/02 |
| WO | 2016/039999 | A1 | 3/2016 | C25B 1/00 |
| WO | 2016/054400 | A1 | 4/2016 | C25D 5/00 |
| WO | 2017/207220 | A1 | 12/2017 | C25B 1/00 |

OTHER PUBLICATIONS

German Search Report, Application No. 102016209451.3, 9 pages, dated Mar. 9, 2017.

Chinese Office Action, Application No. 201780034534.8, 8 pages, dated Dec. 20, 2019.

Delacourt et al., "Design of an Electrochemical Cell Making Syngas (CO+H2) from C02 and H20 Reduction at Room Temperature," Journal of The Electrochemical Society, vol. 155, Issue 1, pp. B42-B49, Nov. 8, 2007.

International Search Report and Written Opinion, Application No. PCT/EP2017/060885, 24 pages, dated Jul. 24, 2017.

* cited by examiner

DEVICE AND METHOD FOR THE ELECTROCHEMICAL UTILISATION OF CARBON DIOXIDE

CROSS-REFERENCE TO RELATED APPLICATIONS

This application is a U.S. National Stage Application of International Application No. PCT/EP2017/060885 filed May 8, 2017, which designates the United States of America, and claims priority to DE Application No. 10 2016 209 451.3 filed May 31, 2016, the contents of which are hereby incorporated by reference in their entirety.

TECHNICAL FIELD

The present disclosure relates to electrochemistry. Various embodiments may include a method and/or an electrolyzer for electrochemical utilization of carbon dioxide.

BACKGROUND

The demand for power varies significantly over the course of the day. There is also variation in the generation of power, with an increasing proportion of power from renewable energies during the course of the day. In order to be able to compensate for a surplus of power in periods with a lot of sun and strong wind when demand for power is low, controllable power plants or storage means are required to store this energy. One of the solutions currently being contemplated is the conversion of electrical energy to products of value which can serve especially as platform chemicals or synthesis gas comprising carbon monoxide and hydrogen. One possible technique for conversion of electrical energy to products of value is electrolysis.

The electrolysis of water to hydrogen and oxygen is known. But the electrolysis of carbon dioxide to give products of value, such as carbon monoxide, ethylene, or formic acid in particular, has also been a subject of research for some years, and there are efforts to develop an electrochemical system that can convert a carbon dioxide stream in accordance with economic interests. Some electrolysis units include a low-temperature electrolyzer in which carbon dioxide as reactant gas is converted in a cathode space with the aid of a gas diffusion electrode. The carbon dioxide is reduced to products of value at a cathode of the electrochemical cell, and water is oxidized to oxygen at an anode. Owing to diffusion limitations at the cathode, use of an aqueous electrolyte can result not only in the formation of carbon monoxide but also disadvantageously in the formation of hydrogen, since the water in the aqueous electrolyte is likewise electrolyzed.

Methods or devices that suppress this unwanted formation of hydrogen at the cathode often lead to further restrictions. For example, in the case of use of a proton-conducting membrane, the cathode should not directly adjoin the proton-conducting membrane since, owing to the relatively high proton concentration at the cathode in this case, the formation of hydrogen is promoted. In order to prevent this, therefore, a gap filled with an electrolyte is typically present between proton-conducting membrane and the cathode. However, the electrolyte used cannot be pure water since the conductivity of pure water would be too low and the result would be a severe drop in voltage in the gap. The use of a mineral acid as electrolyte, especially dilute sulfuric acid, would promote unwanted hydrogen formation since this would increase the proton concentration at the cathode.

In some examples, therefore, the conductivity within the gap between the cathode and the proton-conducting membrane is increased by adding a base or a conductive salt to the water. Hydroxide ions are formed in the nonacidic medium in the reduction of carbon dioxide at the cathode. These in turn form hydrogencarbonate or carbonate with further carbon dioxide. Together with the cations from the base or the cations from the conductive salt, this frequently leads to sparingly soluble substances that can precipitate out in solid form within the electrolysis cell and therefore disrupt the operation of the electrolysis cell.

The use of a gap in the cathode space leads to further disadvantages in carbon dioxide electrolyzers: in particular, the voltage drop across the gap distinctly increases the energy required by the electrolysis cell, and so there is a decrease in the efficiency of the electrolysis cell.

In some examples, the electrolysis cell includes a suitable cathode material which then has to show a maximum overvoltage for the formation of hydrogen. However, metals of this kind are y frequently toxic or lead to adverse environmental effects. More particularly, the metals in question include cadmium, mercury, and thallium. The use of these metals as cathode materials frequently leads to a restriction of the products that can be produced in the electrolysis cell since the product depends to a crucial degree on the reaction mechanism at the cathode. The metals mentioned are unsuitable for the production of the desired materials of value, especially carbon monoxide, formic acid, or ethylene.

SUMMARY

The teachings of the present disclosure may be embodied in an electrolysis cell and/or a method of operating an electrolysis cell, in which hydrogen formation is suppressed and the electrolysis cell can be operated in an energy-efficient manner.

As an example, some embodiments may include an electrolyzer for electrochemical utilization of carbon dioxide, comprising at least one electrolysis cell (1), where the electrolysis cell (1) comprises an anode space (13) having an anode (4) and a cathode space (14) having a cathode (5), a first cation-permeable membrane (3) is disposed between the anode space (13) and the cathode space (14) and the anode (4) directly adjoins the first membrane (3) in the anode space (13), wherein a second anion-selective membrane (2) is disposed between the first membrane (3) and the cathode (5), and the second membrane (2) directly adjoins the first membrane (3) at least partly but not completely, and where the second membrane (2) at least partly directly adjoins the cathode (5).

In some embodiments, a common contact area (9) is disposed between the first membrane (3) and second membrane (2), wherein the size of the contact areas (9) is within a range from at least 80% up to 98% of the membrane area of the first and/or second membranes.

In some embodiments, a spacer device (11) is disposed between the first membrane (3) and second membrane (2).

In some embodiments, the cathode (5) and/or the second membrane (2) comprise relief openings for guiding carbon dioxide and water out of the spacer device (11) into the cathode space on the gas side.

In some embodiments, the spacer device (11) comprises meshes, grids (8) or a porous structure.

In some embodiments, an anion-conductive polymer (12) is disposed at least partly between the cathode (5) and the second membrane (2).

In some embodiments, the cathode (5) comprises at least one of the elements silver, copper, lead, indium, tin or zinc.

In some embodiments, the cathode (5) comprises a gas diffusion electrode.

As another example, some embodiments include a method of operating an electrolyzer for electrochemical utilization of carbon dioxide, comprising the following steps: providing an electrolyzer having an electrolysis cell (1) having an anode space (13) having an anode (4) and a cathode space (14) having a cathode (5), where a first cation-permeable membrane (3) is disposed between the anode space (13) and the cathode space (14), and the anode (4) directly adjoins the first membrane (3), and a second anion-selective membrane (2) is disposed between the first membrane (3) and the cathode (5), and the second membrane (2) directly adjoins the first membrane (3) at least partly but not completely, decomposing carbon dioxide to give a product at the cathode (5) in the cathode space (14), transporting unconverted carbon dioxide as carbonate or hydrogencarbonate from the cathode (5) through the second membrane (2), transporting hydrogen ions from the anode (4) through the first membrane (3), reacting the hydrogen ions and the carbonate or hydrogencarbonate to form carbon dioxide and water between the first membrane (3) and the second membrane (2), and releasing the carbon dioxide via flow channels or pores between the first membrane (3) and the second membrane (2).

In some embodiments, the carbon dioxide released is guided back into the electrolyzer as reactant.

In some embodiments, the electrolyzer is operated with pure water.

In some embodiments, the flow channels or pores are formed by means of a spacer device (11).

In some embodiments, at least one of the products carbon monoxide, ethylene or formic acid is produced.

BRIEF DESCRIPTION OF THE DRAWINGS

Further configurations and further features of the teachings herein are elucidated in detail with reference to the figures which follow. These are purely illustrative configurations and combinations of features that do not imply any restriction of the scope of protection. Features that work in the same way and have the same designation but in different configurations are given the same reference numerals.

The figures show.

DETAILED DESCRIPTION

Figure 1:
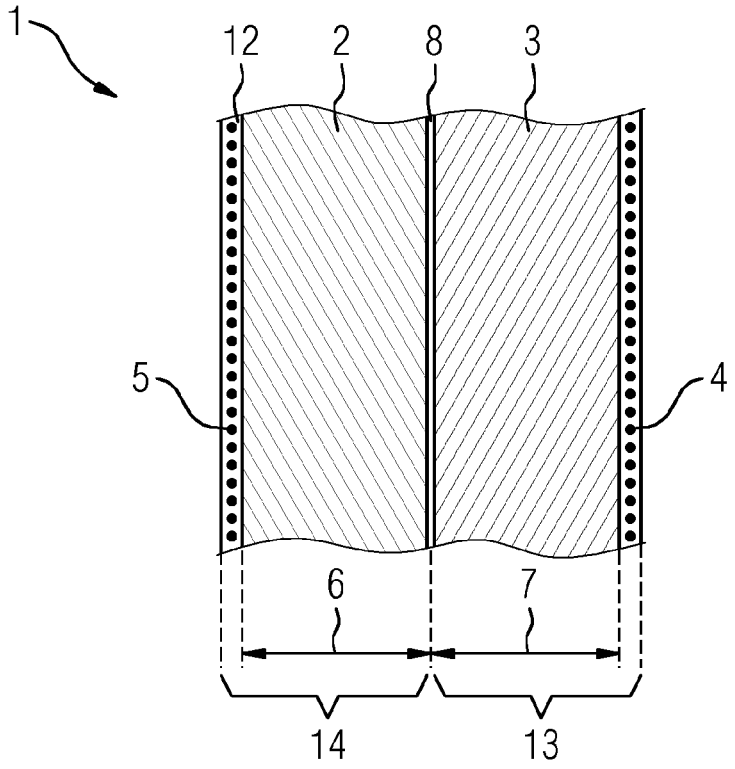
FIG. 1 an electrolysis cell with an anion-selective membrane incorporating teachings of the present disclosure.

In some embodiments, an electrolyzer for electrochemical utilization of carbon dioxide comprises at least one electrolysis cell, where the electrolysis cell comprises an anode space having an anode and a cathode space having a cathode. A first cation-permeable membrane is disposed between the anode space and the cathode space. The anode directly adjoins the first membrane in the anode space. In some embodiments, a second anion-selective membrane is disposed between the first membrane and the cathode, and the second membrane directly adjoins the first membrane at least partly but not completely.

In some embodiments, a method for operating an electrolyzer for electrochemical utilization of carbon dioxide includes: firstly, an electrolyzer having an anode space having an anode and a cathode space having a cathode is provided. A first cation-permeable membrane is disposed between the anode space and the cathode space. The anode directly adjoins the first membrane, and a second anode-selective membrane is disposed between the first membrane and the cathode. The second membrane directly adjoins the first membrane at least partly but not completely. Carbon dioxide is then decomposed in the electrolysis cell to give a product at the cathode in the cathode space. At the same time, unconverted carbon dioxide as carbonate or hydrogencarbonate is transported away from the cathode through the second membrane. At the same time, hydrogen ions from the anode are transported through the first membrane. The hydrogen ions and the carbonate or hydrogencarbonate react between the first membrane and the second membrane to form carbon dioxide and water. The carbon dioxide liberated can then be released via flow channels or pores between the first membrane and the second membrane.

In some embodiments, it is possible to use an electrolysis cell without a gap and without any conductive salt therein. The anion-selective membrane may reduce the evolution of hydrogen at the cathode. The anion-selective membrane typically comprises covalently bonded quaternary amines ($NR_4^+$), and so hydrogen ions cannot cross the anion-selective membrane. In some embodiments, the teachings herein provide release of unconverted carbon dioxide and thus prevent the entry of carbon dioxide into the anode space and hence also mixing of the oxygen formed in the anode space with the carbon dioxide.

In some embodiments, exclusively water and carbon dioxide are used in the electrolyzer. The use of a conductive salt or a base can be avoided. At the anode, water is decomposed to protons and oxygen. The protons can migrate from the anode through the cation-selective membrane into the interspace between the first membrane and the second membrane, especially permeate through the cation-selective membrane. The carbon dioxide is converted at the cathode to a product, e.g., carbon monoxide, formic acid, or ethylene.

Unconverted carbon dioxide can then migrate or permeate together with the hydroxide ions from the aqueous phase through the anion-selective membrane as hydrogencarbonate or carbonate. The first membrane and second membrane are saturated with water. The hydrogencarbonate or carbonate and the hydrogen ions can react in the interspace to give carbon dioxide and water. The carbon dioxide may be guided out of the electrolyzer via flow channels or porous structures out of the interspace. In some embodiments, further relief openings may be present between the flow channels and/or the interspace of the porous structure and the outer surface of the cathode in order to assure recycling of the carbon dioxide and the water.

Anion-selective membranes used may comprise commercially available membranes. More particularly, these include Selemiom AMV from AGC Chemicals, Neosepta from Tokuyama or Fumasep FAB from Fuma GmbH. Positive charges, especially quaternary amines $NR_4^+$, may be immobilized in these membranes. The total charge of the membrane is compensated for by mobile counterions dissolved in the aqueous phase, especially by hydroxide ions. This anion-selective membrane may prevent hydrogen ions from being transported to the cathode. In some embodiments, the cathode material can then be chosen very flexibly. It is thus then possible to select the cathode materials depending on the desired product of value.

In some embodiments, the second membrane at least partly directly adjoins the cathode. The cathode is connected to the anion-selective membrane via macropores for utilization of the internal surface area of the cathode. The macropores typically have a diameter of at least one micrometer. The cathode can be connected to the anion-selective membrane via an anion-selective polymer. The connection may include a solution of the same polymer that penetrates into some of the cathode pores on the membrane side in the preparation. In some embodiments, the surface of the cathode is wetted with a solution of the membrane material and then pressed onto the second membrane.

In some embodiments, the liquid phase comprises ionic components, e.g., hydroxide ions and hydrogencarbonate, that are formed at the cathode and are also mobile in the anion-selective membrane, such that they can be transported through the membrane. This enables the joining of the cathode to the anion-selective membrane and hence also the reduction of the carbon dioxide. In some embodiments, the same ion is mobile in the cathode as in the anion-selective membrane, in the case of water especially hydroxide ions. The connection of the anion-conducting membrane to the cathode is typically effected by impregnating the membrane side of the cathode with anion-conductive polymer. The anion-selective second membrane here at least partly directly adjoins the cathode. The polymer applied becomes part of the membrane through the polymerization.

In some embodiments, there is a common contact area disposed between the first membrane and the second membrane, where the size of the contact area is in the range from at least 80% up to 98% of the membrane area of the first membrane. The membranes are in contact in the electrolysis cell, but they are not completely in contact. On the one hand, if they are not completely in contact, flow channels or pores then remain open to be able to conduct unconverted carbon dioxide and water formed out of the contact region of the two membranes. On the other hand, if the first and second membrane are in contact over a large area, this maintains maximum conductivity within the electrolysis cell and hence to minimize the energy required by the electrolysis cell, i.e. to make it efficient.

In some embodiments, the cathode and/or the second membrane comprises relief openings in order to guide the carbon dioxide and the water out of the spacer device into the cathode space on the gas side. The cathode space on the gas side is on the side of the cathode remote from the anode. The carbon dioxide reactant is supplied from this cathode space on the gas side. Guiding of the water and carbon dioxide formed in the spacer device into the cathode space on the gas side enables higher conversion of the carbon dioxide and hence also higher efficiency.

In some embodiments, a spacer device is disposed between the first membrane and second membrane. This spacer device may comprise meshes, grids, or a porous structure. In some embodiments, it is thus possible to define the contact area between the first membrane and second membrane so as to ensure firstly sufficient flow channels for the carbon dioxide released, and secondly sufficient conductivity of the electrolysis cell.

In some embodiments, the cathode comprises at least one of the elements silver, copper, lead, indium, tin, or zinc. The selection of the cathode material depends especially on the desired product of value from the carbon dioxide decomposition. In some embodiments, carbon monoxide is produced by the use of a silver cathode, ethylene is produced by the use of a copper cathode, and formic acid by the use of a lead cathode.

In some embodiments, the construction of the electrolysis cell allows free choice of the cathode material and simultaneously prevention of the production of unwanted hydrogen at the cathode. The cathode typically takes the form of a gas diffusion electrode. A gas diffusion electrode is understood to mean a porous catalyst structure of good electron conductivity that has been partly wetted with the adjacent membrane material, with remaining pore spaces open to the gas side.

In some embodiments, the unconverted carbon dioxide that has therefore been released again is guided back into the electrolyzer as reactant. In some embodiments, this increases the efficiency of the electrolysis since a maximum amount of carbon dioxide is converted.

In some embodiments, the electrolyzer is operated with pure water. Pure water refers here to water having a conductivity of less than 1 mS/cm. In some embodiments, this prevents salts, especially hydrogencarbonate, from precipitating out in the electrolysis cell and hence leading to a shortened lifetime of the electrolysis cell.

As shown in the Figures, the electrolysis cell 1 may comprise a cathode space 14 and an anode space 13. The cathode space 14 is separated from the anode space 13 by a spacer device 11. In the anode space 13 is disposed a cation-selective membrane 3. The latter directly adjoins an anode 4. In the cathode space 14 is disposed an anion-selective membrane 2. The latter directly adjoins the cathode 5. The cathode 5 is connected to the anion-selective membrane 2 via an anion-selective polymer. A spacer 11 is disposed between the anion-selective membrane 2 and the cation-selective membrane. The membranes are in contact to an extent of 90% via the contact areas 9.

In some embodiments, the electrolysis cell 1 is supplied with voltage, so that electrolysis can take place. Carbon dioxide is reduced to carbon monoxide in the electrolysis cell 1. This typically takes place at a silver cathode. Water is present both in the anion-selective membrane 2 and in the cation-selective membrane 3. Positive charge, especially a proton, can move within the cation-selective membrane 3, to which preferably immobilized negative charges, especially deprotonated sulfonic acid groups, are attached. This is shown by the concentration profile of the hydrogen ion 7 in the anode space 13. By contrast, typically quaternary amines $NR_4^+$ are immobilized at the anion-selective membrane 2, which leads to a charged surface with a positive charge. By virtue of this positively charged surface, negatively charged hydroxide ions in particular can move through this membrane. This is illustrated by the concentration profile of the hydroxide ion 6. Negative charges may be present and transported within the anion-selective membrane 2 in the form of hydrogencarbonate or carbonate (not shown in concentration profile).

If a voltage is now applied to the electrolysis cell 1, the carbon dioxide is reduced to carbon monoxide at the cathode 5 comprising silver. At the same time, water is decomposed in the anode space 13 to give protons and oxygen. The oxygen can leave the anode space. The protons can migrate through the cation-selective membrane 3 into the interspace between grid bars 8 of the grid of the spacer 11. Unconverted carbon dioxide can react with hydroxide ions to give carbonate or hydrogencarbonate and migrate through the anion-selective membrane. The hydrogencarbonate or carbonate and the hydrogen ions can then react in the interspace within the grid structure 8 to give carbon dioxide and water. The carbon dioxide can thus be released again from the electrolysis cell, while the water can diffuse back into the two membranes. In addition, the formation of hydrogen at the cathode is advantageously avoided since the proton cannot cross the anion-selective membrane owing to its positive charge.

In some embodiments, anion-selective membranes that are commercially available are used. In order to firmly join the anion-selective membrane 2 to the cathode 5, the anion-selective membrane 2 and the cathode 5 are firmly joined to one another by means of an anion-selective polymer 12. This anion-selective polymer 12 wets the cathode 5 incompletely, so as to leave openings or pores through to the gas space, through which the carbon dioxide can diffuse. Hydroxide ions are discharged from the cathode 5 through the macropores with utilization of the inner surface area of the cathode 5. This ensures ion transport from the cathode 5 to the anion-selective membrane 2. The cathode 5 may comprise a gas diffusion electrode.

Figure 2:
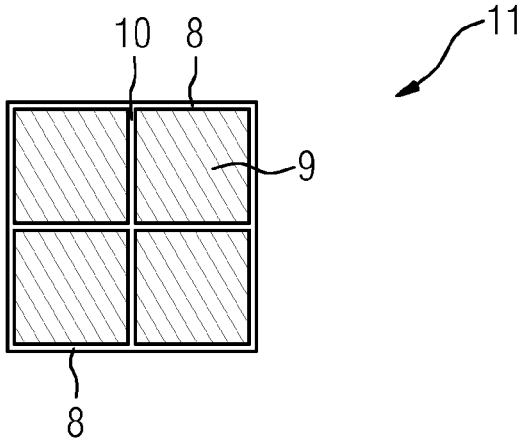
FIG. 2 a spacer for the electrolysis cell with an anion-selective membrane incorporating teachings of the present disclosure.

FIG. 2 shows a section of the spacer device 10 as a grid structure 8. The hatched areas here describe the contact areas of the anion-selective membrane 2 and the cation-selective membrane 3. The white area between the contact area and the grid structure 8 denotes flow channels 10 through which the carbon dioxide formed in the interspace can leave the electrolysis cell. In some embodiments, the spacer 11 separates the carbon dioxide and carbon monoxide from the oxygen anode gas.

In some embodiments, it is possible to use solely water to operate the electrolysis cell 1. This is possible in that the anode and the cathode are arranged relative to one another such that the conductivity through the anion-selective membrane 2 and the cation-selective membrane 3 is sufficiently high. Thus, use of a conductive salt or a buffer is avoided. In some embodiments, as a result, there can be no precipitation of hydrogencarbonates in particular in solid form. The lifetime of the electrolysis cell is thus increased. In addition, this increases the efficiency of the electrolysis cell.

What is claimed is:

1. An electrolyzer for electrochemical utilization of carbon dioxide, the electrolyzer comprising:

electrolysis cell defining an anode space and a cathode space;

an anode in the anode space;

a cathode in the cathode space;

a first cation-permeable membrane disposed between the anode space and the cathode space;

wherein the anode directly adjoins the first cation-permeable membrane;

a second anion-selective membrane disposed between the first cation-permeable membrane and the cathode; and a spacer device disposed between at least part of the first cation-permeable membrane and at least part of the second anion-selective membrane wherein the second anion-selective membrane directly adjoins the first cation-permeable membrane; and the second anion-selective membrane directly adjoins the cathode.

2. The electrolyzer as claimed in claim 1, further comprising a common contact area is disposed between the first cation-permeable membrane and the second anion-selective membrane; and wherein the contact area is within a range from at least 80% up to 98% of a membrane area of the first or second membranes.

3. The electrolyzer as claimed in claim 1, wherein the cathode and/or the second anion-selective membrane comprises relief openings for guiding carbon dioxide and water out of the spacer device into the cathode space.

4. The electrolyzer as claimed in claim 1, wherein the spacer device comprises meshes, grids, or a porous structure.

5. The electrolyzer as claimed in claim 1, further comprising an anion-conductive polymer disposed at least partly between the cathode and the second anion-selective membrane.

6. The electrolyzer as claimed in claim 1, wherein the cathode comprises at least one of the elements selected from the group consisting of: silver, copper, lead, indium, tin, and zinc.

7. The electrolyzer as claimed in claim 1, wherein the cathode comprises a gas diffusion electrode.

8. A method of operating an electrolyzer for electrochemical utilization of carbon dioxide, the method comprising:

decomposing a first amount of carbon dioxide to produce a product at a cathode disposed in a cathode space defined by an electrolysis cell;

transporting unconverted carbon dioxide as carbonate or hydrogencarbonate from the cathode through an anion-selective membrane disposed adjacent the cathode;

transporting hydrogen ions from an anode disposed in an anode space defined by the electrolysis cell through a cation-permeable membrane disposed between the anode space and the cathode space;

wherein the anode directly adjoins the cation-permeable membrane and the anion-selective membrane directly adjoins the cation-permeable membrane;

reacting the hydrogen ions and the carbonate or hydrogencarbonate to form a second amount of carbon dioxide and water between the cation-permeable membrane and the anion-selective membrane; and releasing the second amount of carbon dioxide via flow channels or pores between the cation-permeable membrane and the anion-selective membrane.

9. The method as claimed in claim 8, further comprising guiding the second amount of carbon dioxide back into the electrolyzer as a reactant.

10. The method as claimed in claim 8, wherein the electrolyzer is operated with pure water.

11. The method as claimed in claim 8, wherein the flow channels or pores are formed by means of a spacer device.

12. The method as claimed in claim 8, further comprising forming at least one product selected from the group consisting of: carbon monoxide, ethylene, and formic acid.

* * * * *